US006497466B1

(12) United States Patent
Writt

(10) Patent No.: US 6,497,466 B1
(45) Date of Patent: Dec. 24, 2002

(54) AUTOMATIC PRINT GAP ADJUSTMENT ASSEMBLY FOR AN INK JET PRINTER

(75) Inventor: John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 83 days.

(21) Appl. No.: 09/852,832

(22) Filed: May 10, 2001

(51) Int. Cl.[7] ..... B41J 25/308
(52) U.S. Cl. ..... 347/8; 400/56; 400/59
(58) Field of Search ..... 347/8, 37; 400/56, 400/59

(56) References Cited

U.S. PATENT DOCUMENTS 3,444,978 A 5/1969 Teichmann et al.
4,090,600 A 5/1978 Biedermann
4,773,773 A 9/1988 Itoh
5,000,590 A 3/1991 Einem
5,065,169 A * 11/1991 Vincent et al. ..... 347/8
5,610,636 A 3/1997 Hanabusa et al.
5,800,080 A 9/1998 Lee
5,844,584 A * 12/1998 Murphy, III et al. ..... 347/20
5,961,224 A 10/1999 Baitz et al.

* cited by examiner

*Primary Examiner*—Craig Hallacher
(74) *Attorney, Agent, or Firm*—Elizabeth C. Jacobs

(57) ABSTRACT

An apparatus for adjusting a print media gap on a printer having a printhead carriage configured for selective lateral displacement thereof for controlled printing on print media includes the support member attached to the printhead carriage which encounters a guide assembly mounted to the printer that defines first and second predetermined paths for movement of the printhead at first and second print media gaps, respectively, wherein the first and second predetermined paths converge at path junctions. An assembly is provided for directing a support member on a one of the first and second predetermined paths to provide first and second print media gaps.

17 Claims, 5 Drawing Sheets

AUTOMATIC PRINT GAP ADJUSTMENT ASSEMBLY FOR AN INK JET PRINTER

BACKGROUND OF THE INVENTION

The present invention relates broadly to control systems associated with ink jet printers and, more particularly, to an automatic print gap adjustment assembly to adjust the gap between a printhead and print media.

Modem ink jet printers typically offer high quality printing results. One of the factors that determines the quality of the print produced by an ink jet printer is the gap or spacing between the printhead and the print media. Print quality can be enhanced if the print gap is adjusted to compensate for different media thicknesses. Typically, the adjustment will provide a first print gap for single sheet use and a second print gap for envelope use with the second print gap being wider than the first print gap. The adjustment of the print gap can be accomplished by physically moving the printhead closer or farther away from the media.

Typically the print gap adjustment will be accomplished by manual manipulation of a lever on the printer that the user must operate. The lever usually provides a first position for a first print gap and a second position for a second print gap. Automatic print gap adjustment has typically been accomplished using complex mechanical devices involving eccentric bearings. Accordingly, there exists a need for an inexpensive automatic gap adjustment that requires no user intervention and provides consistent, accurate results.

SUMMARY OF THE INVENTION

It is accordingly an object that the present invention to provide an assembly for automatically adjusting the print gap in an ink jet printer that is mechanically simple and relatively inexpensive to accomplish.

It is another object of the present invention to provide such a print gap adjustment assembly that is accurate and reliable.

To those ends, the present invention is directed to an apparatus for adjusting a print media gap on a printer having a movable printhead carriage configured for selective lateral displacement thereof for controlled printing on print media. The apparatus includes a support member attached to the printhead carriage and projecting therefrom for supporting the printhead during movement thereof. A guide assembly is mounted to the printer for engagement with the support member and defining a first predetermined path for movement of the printhead therealong at a first print media gap and defining a second predetermined path for movement of the printhead therealong at a second print media gap wherein the first predetermined path and the second predetermined path converge at a path junction. An assembly is provided for directing the support member onto one of the first predetermined path to provide the first print media gap and the second predetermined path to provide the second print media gap dependent on a selected print media.

Preferably, the directing assembly includes a first path junction, where the first predetermined path and the second predetermined path converge. The first path junction is disposed at a first end of the guide assembly for movement of the support member from the first predetermined path to the second predetermined path. The directing assembly also includes a second path junction where the first predetermined path and the second predetermined path converge. The second path junction is disposed at a second end of the guide assembly for movement of the support member from the second predetermined path to the first predetermined path.

It is further preferred that the assembly for directing includes a first wall member disposed along the first predetermined path at the first path junction for directing the support member from the first predetermined path to the second predetermined path, and a second wall member disposed along the second predetermined path at the second path junction for directing the support member from the second predetermined path to the first predetermined path.

It is preferential that the directing assembly includes an arrangement associated with the printer for selectively moving the support member to the first path junction for contact with the first wall member to move the support member from the first predetermined path to the second predetermined path for changing a first print gap spacing to a second print gap spacing and for selectively moving the support member to the second path junction for contact with the second wall member to move the support member from the second predetermined path to the first predetermined path, thereby returning the print gap spacing to the first print gap spacing.

The arrangement for moving the support member preferably includes a preprogrammed microcomputer configured for controlling movement of the support member toward the first path junction when changing from a print media having a first thickness to a print media having a second thickness, wherein the second thickness is greater than the first thickness, and the preprogrammed microcomputer may be configured for controlling movement of the support member toward the second path junction when changing from the second print media to the first print media.

It is preferred that the support member includes a wheel rotatebly mounted to an axle and selectively laterally displacable thereon wherein the wheel selectively travels along one of the first predetermined path and the second predetermined path during printing. Preferably, the wheel is configured for abutment with the first wall member and the second wall member for lateral displacement along the axle during a transition between the first predetermined path and the second predetermined path.

It is further preferred that the guide assembly includes a first guide ridge disposed at the first path junction for enhancing the ability of the wheel to remain in the second path after a transition from the first predetermined path to the second predetermined path. The guide assembly may also preferably include a second guide ridge disposed at the second path junction for enhancing the ability of the wheel to remain in the first path after a transition from the second predetermined path to the first predetermined path.

It is further preferred that the guide assembly includes a guide rail having the first predetermined path and the second predetermined path formed therein in a side-by-side relationship. The guide assembly may include a first guide rail having the first predetermined path formed therein and a second guide rail having the second predetermined path formed therein, with the first guide rail and the second guide rail being disposed in a side-by-side relationship.

By the above, the present invention provides a mechanically simple, reliable automatic print gap adjustment assembly that is inexpensive to produce and provides accurate results.

DESCRIPTION OF THE PREFERRED EMBODIMENT

Figure 1:
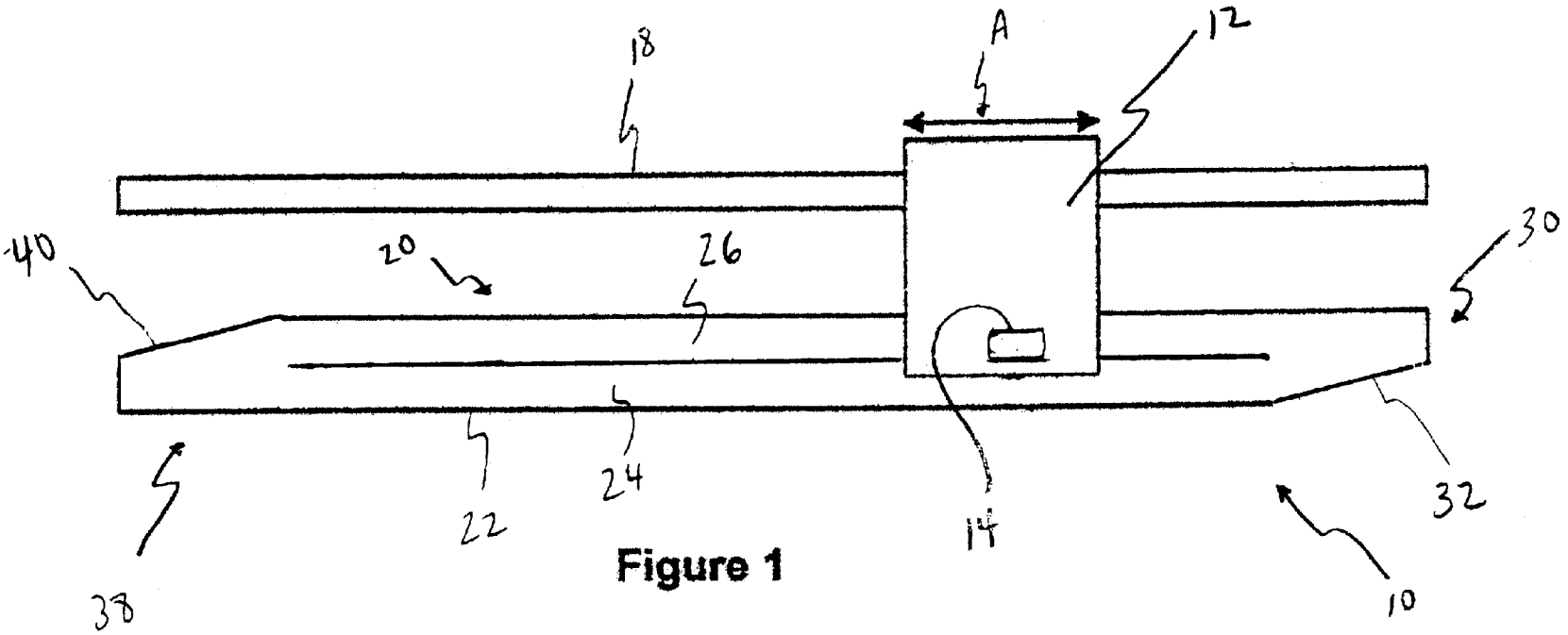
FIG. 1 is a diagrammatic view of a printhead carriage associated with an assembly for adjusting the print gap in an ink jet printer according to one preferred embodiment of the present invention.

Turning now to the drawings and, more particularly to FIG. 1, a print gap adjustment assembly according to one preferred embodiment of the present invention is illustrated generally at 10. Since the present invention provides a relatively simple modification to an existing ink jet printer construction, the diagrammatic views of the present invention are sufficient to instruct those skilled in this art how to practice the present invention. As with most typical ink jet printers, a printhead is carried in a printhead carriage 12 that is configured for reciprocatory motion, as illustrated at A in FIG. 1, at a predetermined print gap spacing with print media such as paper. The printhead carriage 12 rides along a horizontally extending guide rod 18 and a parallelly extending crossbar 22 which is modified or replaced in accordance with the present invention and as will be described in greater detail hereinafter.

Figure 2:
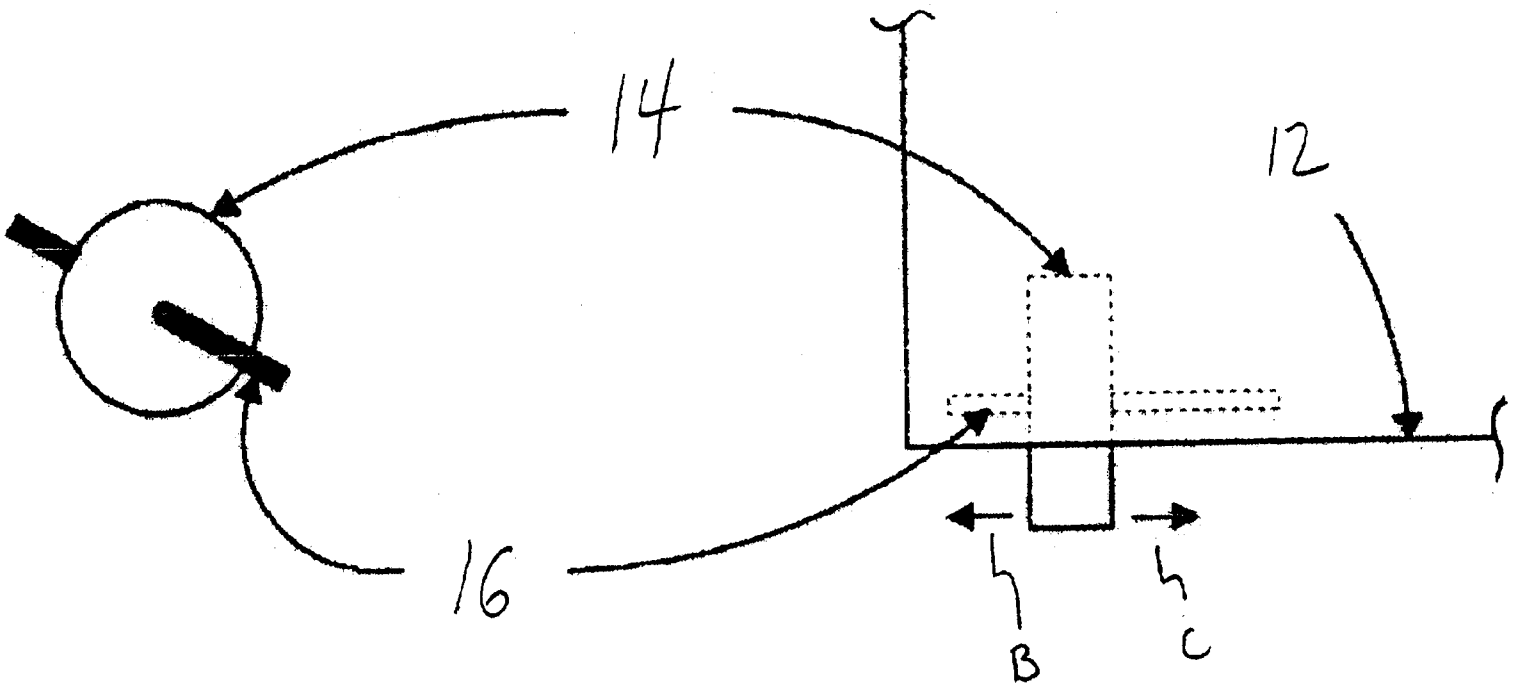
FIG. 2 is a diagrammatic view of a support wheel associated with the print carriage illustrated in FIG. 1.

The printhead carriage 12 includes a support member, preferably in the form of a wheel 14, for contact with the crossbar 22. As seen in FIG. 2, the wheel 14 is mounted to an axle 16 in a manner to allow lateral movement of the wheel 14 along the axle 16 as indicated by arrows B and C in FIG. 2. The lateral movement may be accomplished simultaneously and in addition to rolling movement. The wheel 14 can preferably move a minimum of twice its own width on the axle 16.

As previously stated, the wheel 14 rides on the crossbar 22. The crossbar 22, in accordance with the present invention, includes two grooves or paths 24, 26 formed to extend in a generally parallel relationship the length of the crossbar 22. The wheel 14 is restricted to one of the two paths 24, 26 formed in the crossbar 22. It should be noted that whether the term path, groove, channel or indentation is used, the structure remains essentially the same, that of an extended accommodating recess within which the wheel 14 can travel as the printhead carriage 12 is reciprocated during printing action.

According to the present invention, the print gap is selected by choosing a first path 24 or a second path 26 within the guide assembly 20 for reciprocatory printhead carriage 12 travel during printing. The first path 24 is the default path, provided for so-called "normal" printing, i.e., for printing onto conventional paper at a conventional paper thickness. The high path, designated in FIG. 1 as second path 26, is configured to space the printhead to produce a print gap for thicker print media.

In order to change the print gap, the wheel 14 must be moved from one path to another. The printer is provided with the programming necessary to change between the first path 24 and the second path 26 as necessary by driving the printhead carriage 12 to one extreme or the other on the crossbar 22. The default channel or path is the low or standard path, designated in FIG. 1 as first path 24, and the wheel 14 will stay in this path unless the carriage moves to the side of the printer configured for changing from the first path 24 to the second path 26. Preferably, this is located at an end of the printer opposite the capping station.

Figure 3:
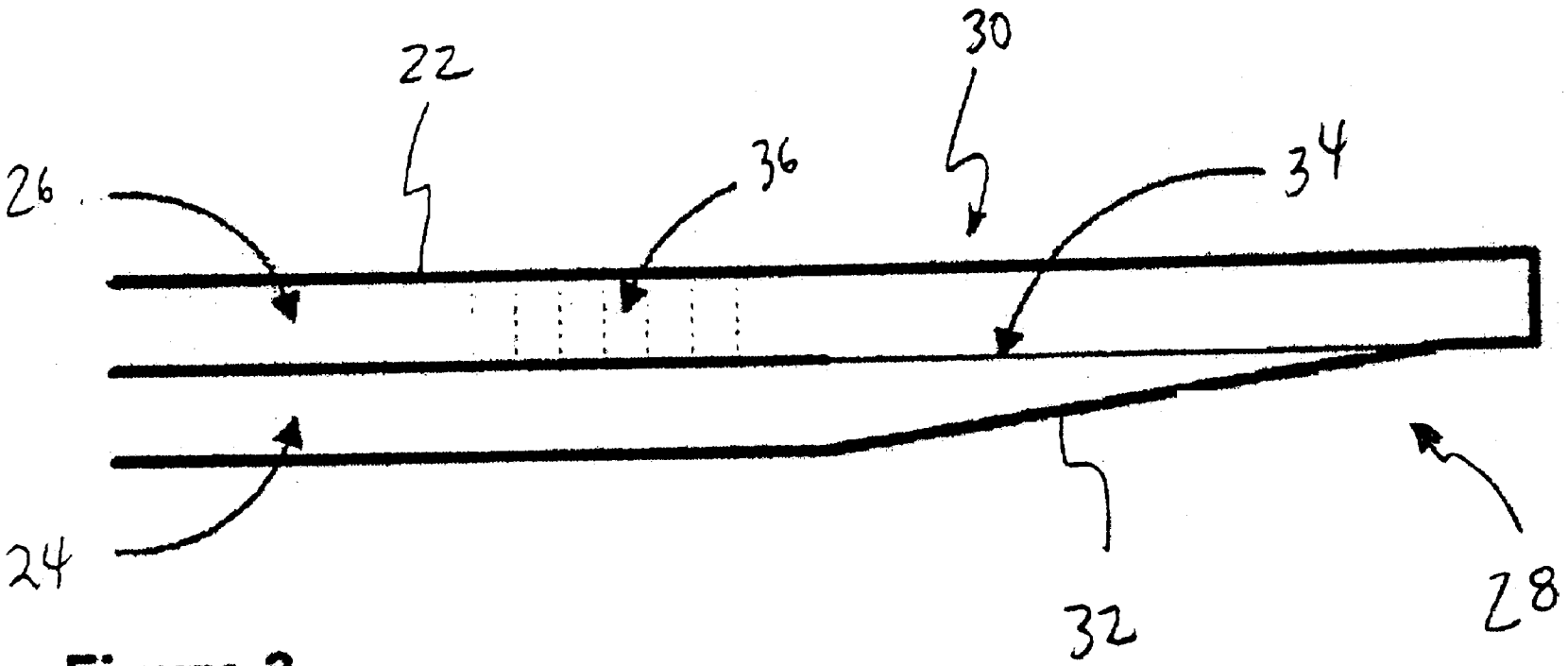
FIG. 3 is a diagrammatic view of a first path junction formed at one end of the assembly illustrated in FIG. 1.

With reference to FIG. 3, a first portion of the directing assembly is illustrated generally at 28. The first path 24 converges on the second path 26 using a wall member 32 which is angled toward the second path 26. Once the printhead carriage 12 travels to the end of the first path 24, it is directed by the wall member 32 out of the first path 24 and into the second path 26. A guide ridge 34 is formed as a divider between the first path 24 and the second path 26 to help maintain the wheel 14 in the second path 26. When the printhead carriage 12 is moved away from the first path junction 30 it encounters a small incline 36 formed in the second path 26 to elevate the printhead carriage 12 to a height associated with the wider print gap spacing.

Figure 4:
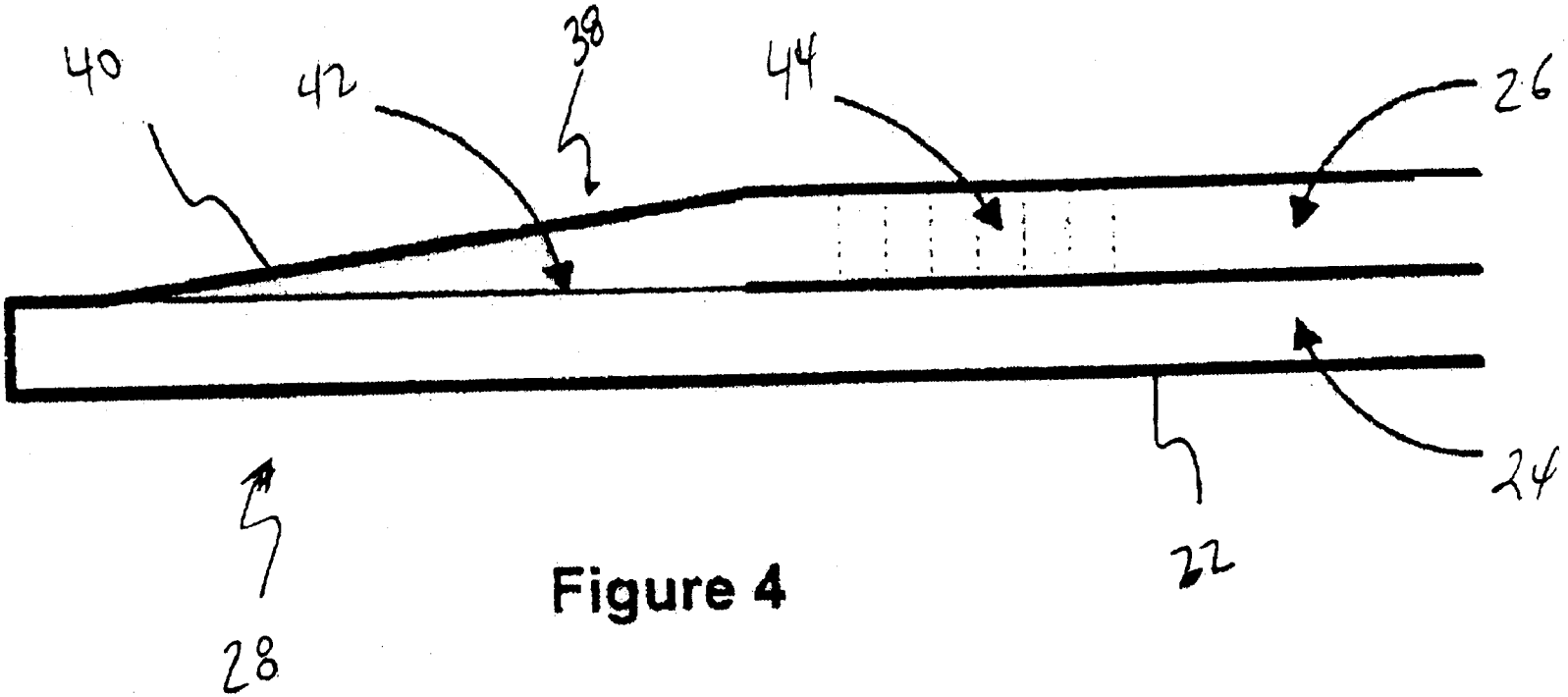
FIG. 4 is a diagrammatic view of a second path junction on the assembly as illustrated in FIG. 1.

Turning now to FIG. 4, a second portion of the directing assembly is illustrated at 28 and is used for directing the wheel 14 out of the second path 26 and into the first path 24. As seen in FIG. 4, this portion of the directing assembly 28 includes a wall member 40 which extends from the second path 26 toward the first path 24. A guide ridge 42 is provided to positively define a boundary between the paths 24, 26 which will prevent the wheel 14 from re-entering the second path 26. An incline 44 is formed on the second path 26 and the wheel 14 must descend this incline before changing to the first path 24.

Figure 5:
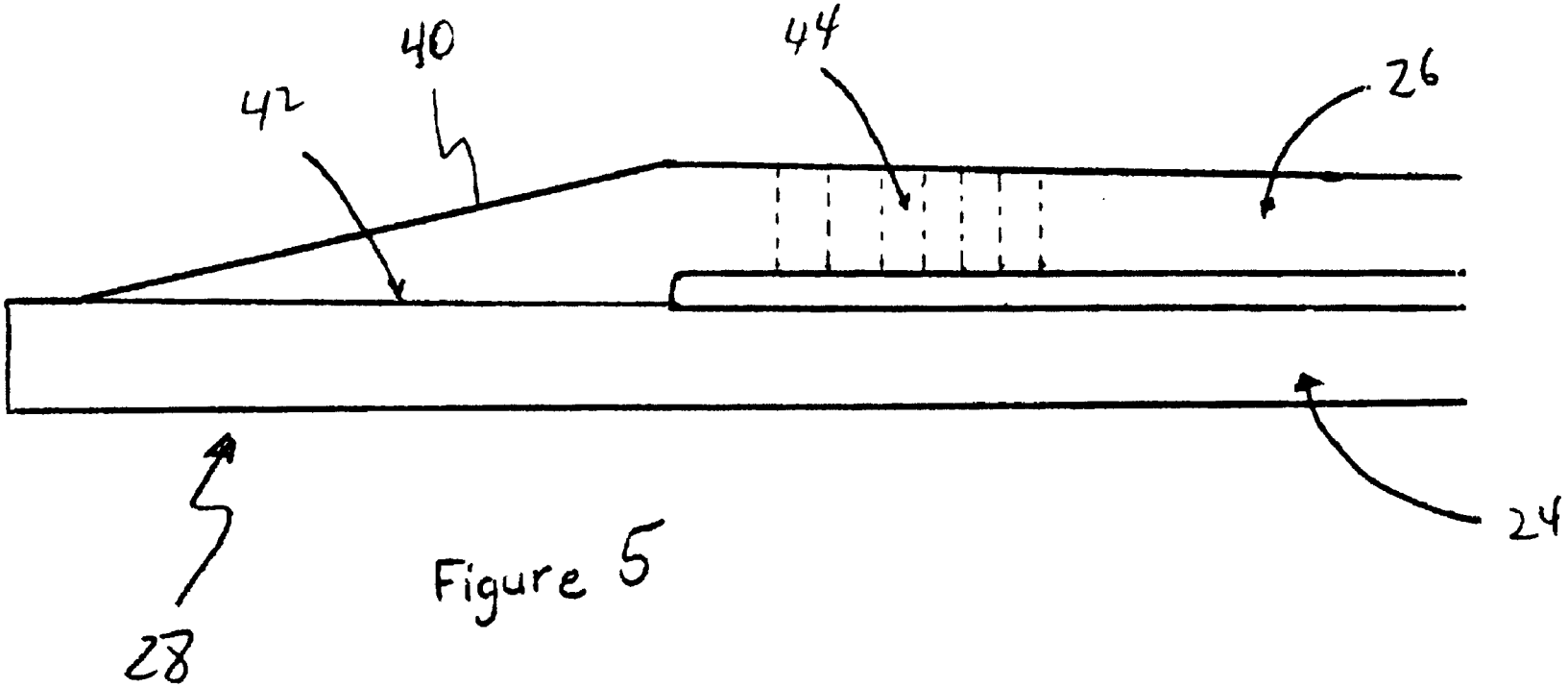
FIG. 5 is a diagrammatic view of a path junction according to another preferred embodiment of the present invention.

Turning now to FIG. 5, a variation of the structure illustrated in FIGS. 3 and 4 is provided and is illustrated only with respect to one end of the crossbar 22. As seen in FIG. 5, the first path 24 and the second path 26 are formed from two separate rails that are fixed to one another at either end in a manner similar to the relationship between the first path 24 and the second path 26 in the first embodiment of the present invention. Depending on the structure of the printer and the crossbar 22 in particular, it may be advantageous to add a second channel to an already existing primary channel. Such a construction would resemble the construction illustrated in FIG. 5.

In operation, the printhead carriage 12 is reciprocated with the wheel 14 tracking in the first path 24. When an envelope is inserted or other paper of increased thickness is used, the printer drives the printhead carriage 12 to the first path junction 30 as illustrated in FIG. 3. There, the wheel 14 encounters the wall member 32 and is driven across the guide ridge 34 into the endmost portion of the second path 26. The printer then causes the printhead carriage 12 to move away from the first path junction 30 and, in doing so, the wheel 14 remains in the second path 26 and travels up the incline 36 to achieve the wider print gap.

When the thicker print media is no longer to be used, the printer drives the printhead carriage 12 to the opposite end where it encounters the second path junction 38. There, the wheel 14 abuts the wall member 40 where it is driven across the guide ridge 42 and into the end most portion of the first path 24. When the printhead carriage 12 is withdrawn and the wheel 14 remains in the first path 24 with the print gap returning to the initial, single sheet print gap.

By the above, the print gap is automatically controlled based on carrier positioning. During normal operation with a standard thickness media, there is no distinction between operation of the present invention and a standard ink jet printer and there is consequently no speed impact since the wheel can only enter the high channel when the printhead carriage 12 is farthest away from the capping station. When thicker media is to be printed upon, the carriage moves to the opposite side of the printer so that the wheel can enter the high channel and then resumes as normal operation so long as there is no capping until the print job is complete.

By the above, the present invention provides a low cost simple and automatic assembly for adjusting the print gap in an ink jet printer.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for adjusting a print media gap on a printer having a movable printhead carriage configured for selective lateral displacement thereof for controlled printing on print media, said apparatus comprising:

a support member attached to the printhead carriage and projecting therefrom for supporting the printhead during movement thereof;

a guide assembly mounted to the printer for engagement with said support member and defining a first predetermined path for movement of the printhead therealong at a first print media gap and defining a second predetermined path for movement of the printhead therealong at a second print media gap wherein said first predetermined path and said second predetermined path converge at a path junction, and an assembly for directing said support member onto one of said first predetermined path to provide the first print media gap and said second predetermined path to provide the second print media gap dependent on a selected print media.

2. An apparatus for adjusting a print media gap according to claim 1 wherein said directing assembly includes a first path junction wherein first predetermined path and said second predetermined path converge, said first path junction being disposed at a first end of said guide assembly for movement of said support member from said first predetermined path to said second predetermined path; and a second path junction wherein said first predetermined path and said second predetermined path converge, said second path junction being disposed at a second end of said guide assembly for movement of said support member from said second predetermined path to said first predetermined path.

3. An apparatus for adjusting a print media gap according to claim 2 wherein said assembly for directing includes a first wall member disposed along said first predetermined path at said first path junction for directing said support member from said first predetermined path to said second predetermined path, and a second wall member disposed along said second predetermined path at said second path junction for directing said support member from said second predetermined path to said first predetermined path.

4. An apparatus for adjusting a print media gap according to claim 3 wherein said directing assembly includes means associated with the printer for selectively moving said support member to said first path junction for contact with said first wall member to move said support member from said first predetermined path to said second predetermined path for changing a first print gap spacing to a second print gap spacing and for selectively moving said support member to said second path junction for contact with said second wall member to move said support member from said second predetermined path to said first predetermined path returning the print gap spacing to said first print gap spacing.

5. An apparatus for adjusting a print media gap according to claim 4 wherein said means for moving said support member includes a preprogrammed microcomputer configured for controlling movement of said support member toward said first path junction when changing from a print media having a first thickness to a print media having a second thickness, wherein said second thickness is greater than said first thickness.

6. An apparatus for adjusting a print media gap according to claim 5 wherein said means for moving said support member includes a preprogrammed microcomputer configured for controlling movement of said support member toward said second path junction when changing from the second print media to the first print media.

7. An apparatus for adjusting a print media gap according to claim 6 wherein said support member includes a wheel rotatebly mounted to an axle and selectively laterally displacable thereon wherein said wheel selectively travels along one of said first predetermined path and said second predetermined path during printing.

8. An apparatus for adjusting a print media gap according to claim 7 wherein wheel is configured for abutment with said first wall member and said second wall member for lateral displacement along said axle during a transition between said first predetermined path and said second predetermined path.

9. An apparatus for adjusting a print media gap according to claim 8 wherein said guide assembly includes a first guide ridge disposed at said first path junction for enhancing the ability of said wheel to remain in said second path after a transition from said first predetermined path to said second predetermined path.

10. An apparatus for adjusting a print media gap according to claim 9 wherein said guide assembly includes a second guide ridge disposed at said second path junction for enhancing the ability of said wheel to remain in said first path after a transition from said second predetermined path to said first predetermined path.

11. An apparatus for adjusting a print media gap according to claim 1 wherein said guide assembly includes a first guide rail having said first predetermined path formed therein and a second guide rail having said second predetermined path formed therein, with said first guide rail and said second guide rail being disposed in a side-by-side relationship.

12. An apparatus for adjusting a print media gap according to claim 1 wherein said guide assembly includes a guide rail having said first predetermined path and said second predetermined path formed therein in a side-by-side relationship.

13. An apparatus for adjusting a print media gap on a printer having a movable printhead carriage configured for selective lateral displacement thereof for controlled printing on print media, said apparatus comprising:

a wheel rotatably mounted to an axle and laterally displacable thereon and attached to the printhead carriage to project therefrom for supporting the printhead during movement thereof;

at least one guide rail mounted to the printer for engagement with said support member and defining a first predetermined path for movement of the printhead therealong at a first print media gap and defining a second predetermined path for movement of the printhead therealong at a second print media gap wherein said first predetermined path and said second predetermined path converge at a first path junction disposed at a first end of said guide assembly for movement of said support member from said first predetermined path to said second predetermined path and said first predetermined path and said second predetermined path converge at a second path junction disposed at a second end of said guide assembly for movement of said support member from said second predetermined path to said first predetermined path, a first wall member disposed along said first predetermined path at said first path junction for directing said support member from said first predetermined path to said second predetermined path;

a second wall member disposed along said second predetermined path at said second path junction for directing said support member from said second predetermined path to said first predetermined path; and means associated with the printer for selectively moving said support member to said first path junction for contact with said first wall member to move said support member from said first predetermined path to said second predetermined path for changing a first print gap spacing to a second print gap spacing and for selectively moving said support member to said second path junction for contact with said second wall member to move said support member from said second predetermined path to said first predetermined path returning the print gap spacing to said first print gap spacing.

14. An apparatus for adjusting a print media gap according to claim 13 wherein said means for moving said support member includes a preprogrammed microcomputer configured for controlling movement of said support member toward said first path junction when changing from a print media having a first thickness to a print media having a second thickness, wherein said second thickness is greater than said first thickness.

15. An apparatus for adjusting a print media gap according to claim 14 wherein said means for moving said support member includes a preprogrammed microcomputer configured for controlling movement of said support member toward said second path junction when changing from the second print media to the first print media.

16. An apparatus for adjusting a print media gap according to claim 13 and further comprising a first guide ridge disposed at said first path junction for enhancing the ability of said wheel to remain in said second path after a transition from said first predetermined path to said second predetermined path.

17. An apparatus for adjusting a print media gap according to claim 16 and further comprising a second guide ridge disposed at said second path junction for enhancing the ability of said wheel to remain in said first path after a transition from said second predetermined path to said first predetermined path.

* * * * *